US005345885A

United States Patent [19]

Yoshino

[11] Patent Number: 5,345,885

[45] Date of Patent: Sep. 13, 1994

[54] LOOPER OF TUFTING MACHINE

[75] Inventor: Sota Yoshino, Sakai, Japan

[73] Assignee: Nara Company, Ltd., Osaka, Japan

[21] Appl. No.: 100,266

[22] Filed: Aug. 2, 1993

[30] Foreign Application Priority Data

Sep. 9, 1992 [JP] Japan ..... 4-063177[U]

[51] Int. Cl.[5] ..... D05C 15/24

[52] U.S. Cl. ..... 112/80.55

[58] Field of Search ..... 112/80.55, 80.5, 80.58, 112/80.59

[56] References Cited

U.S. PATENT DOCUMENTS 4,274,346 6/1981 Carnaby ..... 112/80.55

4,602,576 7/1986 Cox ..... 112/80.55

*Primary Examiner*—Clifford D. Crowder

*Assistant Examiner*—Paul C. Lewis

*Attorney, Agent, or Firm*—Wenderoth, Lind & Ponack

[57] ABSTRACT

Looper for a tufting machine proposed to improve the yarn cutting performance with a knife in resilient contact with the looper. The knife abutting surface is bent about 2 degrees with respect to the handle toward the knife.

4 Claims, 1 Drawing Sheet

LOOPER OF TUFTING MACHINE

BACKGROUND OF THE INVENTION

This invention relates to a looper of a tufting machine for tufted carpets.

As shown in FIGS. 3 and 4, a looper is a flat steel plate having a substantially Z-shape and comprising a handle 11 to be attached to a tufting machine, a stem 12, a yarn engaging rod 13 and a hook 14. A rectangular knife 15 slides up and down in contact with the right side face the looper, kept inclined at an angle $\beta$ (FIG. 4), to cut pile yarns 16 hooked on the yarn engaging rod 13.

This looper has a yarn guiding recess 17 on one side of the yarn engaging rod 13 opposite to the side facing the knife 15. Because of the provision of this recess, the looper is liable to become bent in a direction away from the knife due to stress produced during quenching. If this occurs, the knife will not abut the looper properly during tufting, so that thick yarns (e.g. those of more than 5000 denier) cannot be cut at all. Failure to cut occurs even with small-diameter yarns. Tufted carpets made with such a bent looper will not be attractive to the eye because the cut pile surfaces are uneven. Further, such a bent looper will require higher motor power because the contact pressure for the cutting knife will have to be increased.

The greater the contact pressure or contact area between the knife 15 and the yarn engaging rod 13, the higher the frictional resistance therebetween tends to be. Thus, the looper will be more quickly worn and the pile yarns might be broken or fused.

SUMMARY OF THE INVENTION

It is therefore an object of this invention to provide a looper for use in a tufting machine with which the knife can come into contact more reliably and which insures a clear cut with the knife.

According to this invention, a knife abutting surface formed on one side of the stem, the yarn engaging rod and the hook is bent by about 2 degrees with respect to the handle of the looper toward a knife which is disposed on one side of the looper.

Since the looper is bent slightly toward the knife, the knife can be kept in resilient and close contact with the looper while sliding on the looper, with the contact area therebetween kept to a minimum. This makes it possible to concentrate the yarn cutting energy on the cutting point.

Further, since the frictional resistance is lower, Frictional heat produced is kept to a minimum.

Sliding like scissors, the knife is kept in close contact with the looper, with the contact area therebetween kept to a minimum. Thus, the cutting energy can concentrated on the cutting point, so that a clear cut is on possible even a rather thick yarn, which could not be cut with a conventional looper.

Further, the looper of this invention can maintain its high performance without the need of fine adjustment of the knife position. Due to low frictional resistance, yarns can be cut at higher speed with less motor power. The frictional heat can be limited to a minimum. This eliminates melting and fusing of the cut pile yarns at their tips, so that a Beautiful cut pile surface is obtainable.

BRIEF DESCRIPTION OF THE DRAWINGS

Other features and objects of the present invention will become apparent from the following description made with reference to the accompanying drawings, in which.

DETAILED DESCRIPTION OF THE INVENTION

Figure 1:
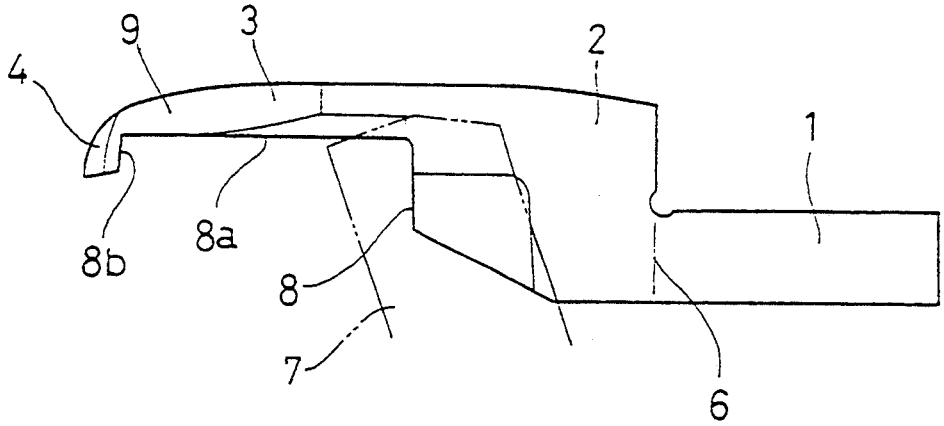
FIG. 1 is a side view of the looper for use in a tufting machine according to this invention, showing it in use.
Figure 2:
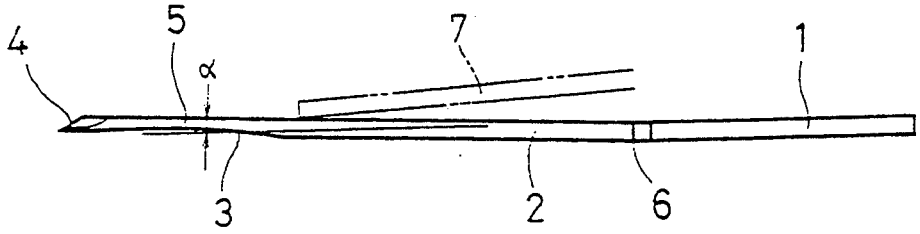
FIG. 2 is a plan view of the same.
Figure 3:
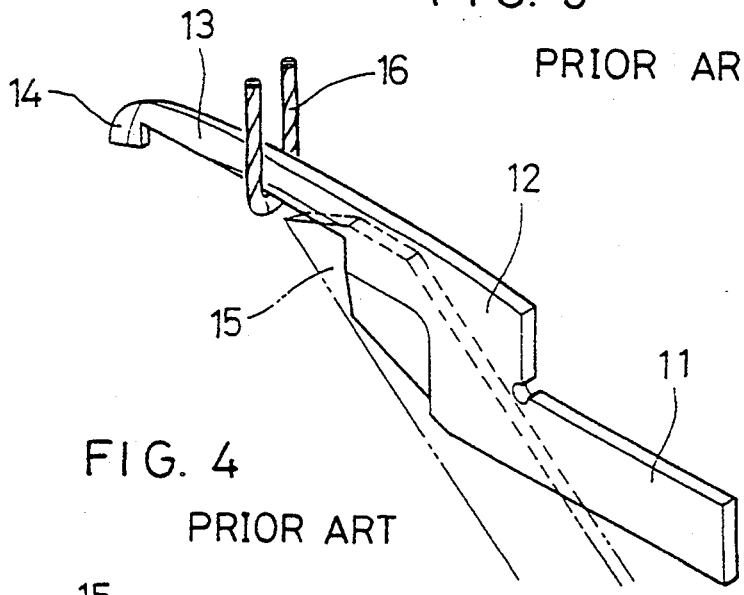
FIG. 3 PRIOR ART
FIG. 3 is a perspective view of a conventional looper in use.
Figure 4:
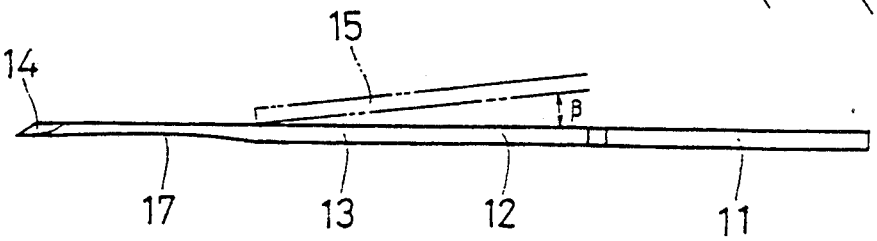
FIG. 4 PRIOR ART
FIG. 4 is a plan view of the same.

As shown in FIGS. 1 and 2, the looper for use in a tufting machine according to this invention is a flat steel plate having a substantially Z-shape as viewed from the side and comprising a substantially rectangular handle 1, a substantially trapezoidal stem 2 extending from the front end of the handle 1, a substantially rectangular yarn engaging rod 3 integral with the stem 2, and a hook 4 integral with the rod 3. The knife abutting surface 5 on the looper is bent (or angled) relative to the side surface of the handle 1, beginning at a line 6 at the front end of the handle 1, toward a knife 7 (or upwardly as viewed in FIG. 2) by an angle which is about 2 degrees.

The knife abutting surface 5 is formed with a cutting edge 8 on the front edge of the stem 2, a cutting edge **8*a* on the bottom edge of the yarn engaging rod 3, and a cutting edge 8*b* on the rear edge of the hook 4. On the side opposite to the knife abutting surface 5 is formed a moderately sloped yarn guiding recess 9**.

The line 6 at the front end of the handle 1 and the bottom edge of the yarn engaging rod 3 are substantially perpendicular to each other (as shown in FIG. 1).

The angle $\alpha$, that is, the bending angle may be determined according the intended use.

By attaching the handle 1 of this looper to the needle bed of a tufting machine, its stem 2, yarn engaging rod 3 and hook 4 will protrude from the needle bed so as to be inclined toward the knife by an angle of about 2 degrees with respect to the direction in which pile yarns are fed. This arrangement and the inherent resiliency of the looper, formed of a thin steel plate, ensure that the knife will be pressed resiliently and tightly against the looper.

What is claimed is:

1. A looper for use in a tufting machine having a knife, said looper comprising:

an elongated handle having a first end and a second end, said first end of said handle being adapted to be mounted to the tufting machine;

a stem integrally attached at a first end thereof to said second end of said handle and extending therefrom in a substantially longitudinal direction of said handle;

a yarn engaging rod having a first end integrally attached to a second end of said stem and extending therefrom substantially in the longitudinal direction;

a hook integrally mounted at a second end of said yarn engaging rod;

wherein said handle, said stem, said yarn engaging rod, and said hook are respectively formed with first side surfaces, and are respectively formed with second side surfaces opposite said first side surfaces;

wherein said first side surfaces of said handle, said stem, said yarn engaging rod, and said hook are contiguous with one another;

wherein said first side surfaces of said stem, said yarn engaging rod, and said hook together constitute a knife abutting surface of said looper which is adapted to be abutted by the knife of the tufting machine; and wherein a bend is formed at a junction between said second end of said handle and said first end of said stem, such that said knife abutting surface is angled, in a transverse direction, relative to said first side surface of said handle.

2. A looper as recited in claim 1, wherein said knife abutting surface is angled relative to said first side surface of said handle in a direction from said second side surface of said handle toward said first side surface of said handle.

3. A looper as recited in claim 1, wherein said knife abutting surface is angled by about 2 degrees relative to said first side surface of said handle in a direction from said second side surface of said handle toward said first side surface of said handle.

4. A looper as recited in claim 1, wherein said knife abutting surface is angled by about 2 degrees relative to said first side surface of said handle.

* * * * *